United States Patent [19]

Killion et al.

[11] Patent Number: 4,677,675

[45] Date of Patent: Jun. 30, 1987

[54] RESPONSE-MODIFYING ACOUSTIC COUPLERS FOR HEARING AIDS

[76] Inventors: Mead C. Killion, 935 Wilshire Ave., Elk Grove Village, Ill. 60007; Donald L. Wilson, 330 Warren Rd., Glenview, Ill. 60025

[21] Appl. No.: 776,937

[22] Filed: Sep. 17, 1985

[51] Int. Cl.[4] ..... H04R 25/02

[52] U.S. Cl. ..... 381/68.2; 381/68.7; 181/129

[58] Field of Search ..... 381/69, 87; 179/107 H, 179/107 FD; 181/129, 182, 183, 185, 186, 189, 192, 194, 196, 135, 137

[56] References Cited

U.S. PATENT DOCUMENTS

| | | | |
|---|---|---|---|
| 1,731,523 | 10/1929 | Cooley | 181/196 |
| 4,296,829 | 10/1981 | Pedersen | 179/107 H |
| 4,451,709 | 5/1984 | Waxman | 179/107 H |
| 4,498,555 | 2/1985 | Cerny | 179/107 H |

OTHER PUBLICATIONS

"Earmold Options for Wideband Hearing Aids" by Mead C. Killion, *Journal of Speech and Hearing Disorders,* 46, 1981, p. 10.

"An Extended Range Universal Earmold" by Hyman Goldberg, *Hearing Aid Journal*—Mar. 1978.

"Venting Without Feedback—Further Development of the High-Cut Cavity Vent", by John Macrae, *Hearing Instruments,* vol. 33, No. 4, 1982, p. 12.

"No-Mold Fitting of Hearing Aids" by O. Berland, *Earmolds and Associated Problems, S. Dalsgaard, Ed., Scandinavian Audiology,* Suppl. 5, 1975, p. 188.

"Recent Development in Hearing Aid Design and Fitting Techniques" by Hans Bergenstoff, *Danavox Report,* 81-09-28, *Danavox A/S,* Copenhagen, 1981, p. 6, and FIG. 11.

"A Low Frequency Emphasis Open Canal Hearing Aid" by Mead C. Killion, Charles I. Berlin and Linda Hood, *Hearing Instruments,* Aug. 1984, pp. 30–34.

"Acoustic Modifications for Better Hearing Aid Fittings" by John Macrae, *Hearing Instruments,* vol. 34, No. 12, 1983, pp. 8 & 11.

"A Special Purpose Dual-Diameter Earmold System", by Samuel F. Lybarger, presented at the *American Hearing Research Foundation Workshop* in Chicago, Jun. 1980.

*Primary Examiner*—Gene Z. Rubinson
*Assistant Examiner*—L. C. Schroeder
*Attorney, Agent, or Firm*—Neuman, Williams, Anderson & Olson

[57] ABSTRACT

Response-modifying acoustic couplers are provided for use between an output port of a hearing aid unit and an earmold at the entrance to the ear of a wearer, including a passage and a chamber which respectively provide a high acoustic inertance and a high acoustic compliance to cooperate with other acoustic elements and to form an acoustic network producing a predetermined frequency response characteristic.

12 Claims, 11 Drawing Figures

RESPONSE-MODIFYING ACOUSTIC COUPLERS FOR HEARING AIDS

This invention relates to acoustic couplers for hearing aids and more particularly to acoustic couplers which cooperate with hearing aids and earmolds or the like to compensate for various types of hearing losses. The couplers of the invention are of compact size and are usable as earhooks for connection to and support of behind-the-ear hearing aid units, requiring no modifications of such units. They are especially advantageous in "problem" cases in which the needs of particular wearers are not satisfied by prior hearing aid systems.

BACKGROUND OF THE INVENTION

Much has been written in the last decade about the use of special earmold constructions to change the frequency response of a hearing aid by modifying the sound channel. These modifications range from simple changes in the diameter of the sound channel at appropriate locations (Killion, M.C. "Earmold options for wideband hearing aids", J. SPEECH AND HEARING DISORDERS 46, 1981, p. 10) to more complicated designs using cavity resonances either in the main sound channel (Goldberg, H. "An extended range universal earmold", HEARING AID JOURNAL, Mar 1978, p. 10) or in the vent channel (Macrae, J. "Venting without feedback-further development of the high-cut cavity vent", HEARING INSTRUMENTS, 33, Apr. 1982 p. 12).

Special earhook designs can also be used to modify the frequency response of a hearing aid. Existing designs include the "high pass" earhook with a small hole near the tip (Berland, O. "No-mold fitting of hearing aids", in EARMOLDS AND ASSOCIATED PROBLEMS, S. Dalsgaard, Ed., SCANDINAVIAN AUDIOLOGY Suppl. 5, 1975, p. 188) and an "E-HOOK" with a small plastic insert (Bergenstoff, H. "Recent Development in hearing aid design and fitting techniques", Danavox Report 81-09-28, Danavox A/S Copenhagen, 1981, p. 6 and FIG. 11).

Another prior development relates to a lowfrequency emphasis, open-canal hearing aid including a specially constructed hearing aid unit cooperating with an earhook which contains two filter chambers (Killion, M. C., Berlin, C.I. and Hood, L. "A low frequency emphasis open canal hearing aid." HEARING INSTRUMENTS 35, Aug. 1984, 30–34.).

An additional prior disclosure relates to the use of a notch filter within a specially designed earmold. (Macrae, J. "Acoustic modifications for better hearing aid fittings." HEARING INSTRUMENTS, 34, Dec. 8,11, 1983). That earmold was designed to compensate for a type of hearing loss that "may occur too rarely to justify the production of a model of hearing aid designed especially for it".

Still another prior disclosure relates to a specially designed earmold system. (Lybarger, S. "A special purpose dual-diameter earmold system." Presented at American Hearing Research Foundation Workshop, Chicago, June 1980.) That system was described as being "especially effective for open canal fittings on persons whose hearing remains fairly normal up to 1500 or 2000 Hz and then drops off markedly."

Such prior constructions have been used advantageously but have been expensive to manufacture, have not always met the needs of wearers and have had problems and disadvantages not previously recognized.

SUMMARY OF THE INVENTION

This invention was evolved with the general object of obtaining improved hearing aid performance, especially in problem cases, while obtaining safe and reliable operation and decreasing manufacturing costs and otherwise increasing the availability of satisfactory hearing aids to persons with impaired hearing.

Important aspects of the invention relate to the recognition and discovery of sources of problems with prior art arrangements. In the aforementioned low frequency emphasis hearing aid, problems are presented by the inclusion of an acoustic resistance element or damper and an acoustic inertance element in the form of tubing having a length of on the order of 75 mm. Such elements were located within a behind-the-ear hearing aid unit, making the construction rather expensive.

The aforementioned notch filter and dual diameter arrangements have had similar problems with respect to cost of fabrication and/or with respect to obtaining satisfactory overall performance of the system. For example, in attempts to use a dual diameter earmold, it was found that considerable improvement can indeed be obtained at high frequencies but it was discovered that the gain was excessive and difficult to reduce in a narrow range of frequencies at around 2000 Hz.

In accordance with the invention, these and other problems are overcome through features of construction of a coupler which, in illustrated embodiments, is in the form of an earhook extending from a behind-the-ear hearing aid unit up and over the ear and down to an earmold which is inserted in the ear cavity. A chamber is provided within a hollow housing, the chamber being coupled to the earmold through acoustic elements which may take different forms and have different characteristics, depending upon the type of hearing loss to be corrected. The chamber is separated from the input end of the coupler by a separating wall portion therebetween.

A very important feature is in the provision of an elongated passage which has an input end coupled to the output of the hearing aid unit and which extends through the separating wall portion and to an output end coupled directly or indirectly to the chamber as well as to the earmold. The passage has a cross-sectional size and volume which are quite small in relation to those of the chamber and the passage provides an acoustic element which has a relatively high acoustic inertance while the chamber provides an acoustic element having a relatively high acoustic compliance. The frequency response characteristic of the resulting acoustic network within the coupler is such that a predetermined overall response characteristic is obtained, related to the needs of the particular wearer or type of wearer for which the coupler is designed.

In accordance with a specific feature of the invention, the elongated passage has a small cross-sectional size such that a high inertance is obtained with a short length which is preferably less than the overall length of the coupler so as to obviate the need for a coiled tubing. The use of a small cross-sectional size has an additional advantage in applications in which it is desirable to provide a damping or resistive element. As hereinafter described the use of a separate damping element is obviated and other advantages are obtained. The invention takes advantage of the fact that the acoustic mass varies inversely with the cross-sectional area and the fact that the acoustic resistance varies inversely as the square of the cross-sectional area and in proportion to the square root of frequency, at higher frequencies.

An important advantage of the construction is that it is not necessary to use a specially constructed hearing aid unit, couplers of the invention being usable with various standard types of hearing aid units which typically have a high acoustic output impedance. They are usable with standard types of earmolds and they are also usable with earmolds having special constructions. The construction has additional advantages in making it possible to readily compensate for a number of types of hearing losses, including losses which are not very common and for which available hearing aids are inappropriate or unsatisfactory.

One illustrated coupler of the invention, referred to herein as the low-pass coupler or earhook, is usable with a standard type of hearing aid unit and with a standard type of earmold and it operates to obtain enhanced low frequency response and to compensate for a type of hearing impairment which is not common but which can be very troublesome to those afflicted therewith.

In the low-pass coupler, a second wall portion is provided at an intermediate position along the length of the coupler to provide an additional chamber which forms an additional acoustic element having a relatively high acoustic compliance. A second elongated passage is provided between the two chambers and it provides an additional acoustic element which has a relatively high acoustic inertance. In this embodiment, the second chamber may extend to the output end of the coupler to be coupled to the earmold.

With this combination of elements, all included within the coupler, the desired low pass filter response characteristic is obtained. By way of example, a peak response may be obtained at a frequency of approximately 350 Hz, falling off at approximately 10 dB per octave between 350 and 1,300 Hz and then falling off at approximately 30 dB per octave above 1,300 Hz.

In additional embodiments of the invention, the coupler includes acoustic elements which cooperate with the first-mentioned elongated passage and chamber to provide a band reject filter section. In particular, a second wall portion is provided which preferably is located close to the output end of the coupler, a second chamber of relatively small volume being provided adjacent to the output end. The first-mentioned elongated passage extends through the second wall portion, as well as the first, and a second passage is provided in the second wall portion to extend from the second chamber to the first chamber. The second passage defines an acoustic element having a relatively high acoustic inertance which is effectively in series with the high acoustic compliance of the first chamber, so as to provide a section which is in shunt relation to the path of energy propagation and which has low acoustic impedance at a certain frequency.

Thus a band reject filter is formed by elements entirely within the acoustic coupler of the invention. A band reject filter so formed has important advantages in a number of applications. One coupler of the invention, referred to herein as a notch-filter coupler or earhook, is designed for use in aiding the hearing of an individual who has normal or near-normal hearing at frequencies within a narrow frequency range but who has a substantial hearing loss at frequencies lower than and higher than the narrow frequency range. With the band reject filter constructed to attenuate frequencies within such a narrow range, it is possible to obtain high amplification of components at frequencies above and below the range so as to permit better hearing by an individual with the aforementioned type of hearing loss.

Another coupler of the invention also uses a band reject filter, but is referred to as a high-pass coupler or earhook. The first passage has dimensions such as to produce a substantial downward shift in the frequency at which a first principal peak response of the system is obtained, while the band reject filter produces a reduced response in a relatively broad intermediate range of frequencies. The high frequency response is substantially unaffected. The high-pass coupler produces a considerable improvement in the hearing of an individual who has a loss in a high frequency range. It is usable with standard earmolds and, in some applications, it is especially effective when used in combination with the aforementioned dual-diameter earmolds which further attenuate mid-frequencies and boost high frequency components.

Thus, couplers are provided which compensate for a variety of types of hearing losses. The couplers are compact and, for operation with behind-the-ear hearing aid units, they may be operative as earhooks to extend up and over the ear and down to an earmold. It will be understood, however, that important features of the invention may be used in any hearing aid applications in which it is desired to compensate for hearing losses, using couplers of compact form.

This invention contemplates other and more specific objects, features and advantages which will become more fully apparent from the following detailed description taken in conjunction with the accompanying drawings.

DESCRIPTION OF PREFERRED EMBODIMENTS

Figure 1:
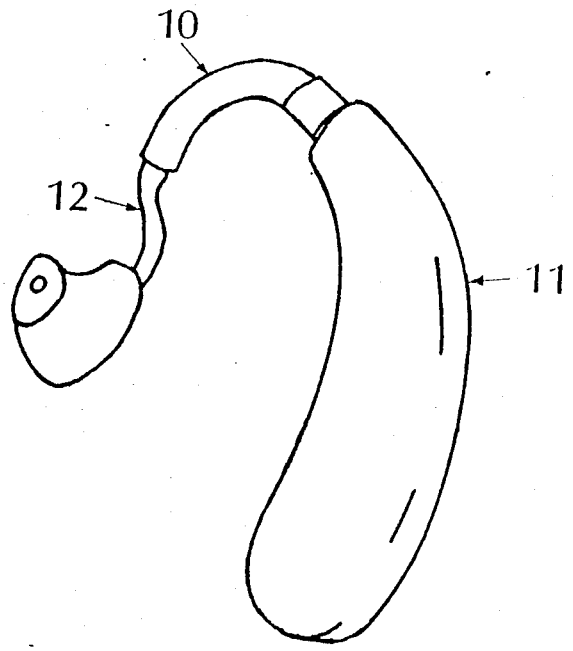
FIG. 1 is a side elevational view showing a coupler constructed in accordance with the invention, operative as an earhook between a hearing aid and an earmold.

Reference numeral 10 generally designates an acoustic coupler constructed in accordance with the invention, constructed to provide an earhook which extends over the ear of a wearer to support and provide an acoustic connection between a behind-the-ear hearing aid unit 11 and an earmold 12.

Figure 2:
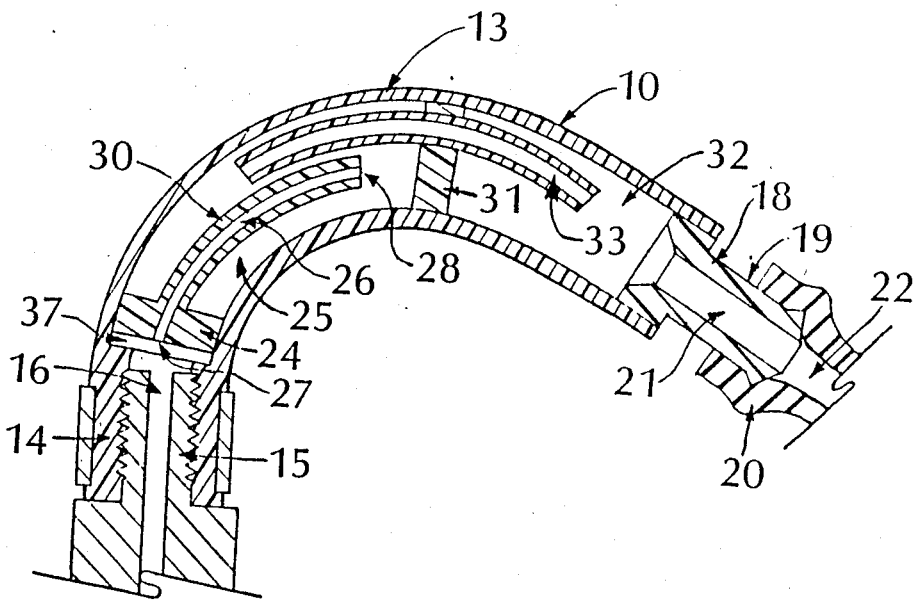
FIG. 2 is a cross-sectional view of a coupler such as shown in FIG. 1, showing a construction of a coupler of the invention which is operative as a "low-pass earhook"

As shown in the cross-sectional view of FIG. 2, the coupler 10 includes a hollow generally tubular housing 13 with an integral input coupling 14 at one end. The input coupling 14 is threaded onto an externally threaded output nozzle or fitting 15 of the hearing aid unit 11, for receiving sound from an output port 16 formed by a central opening of the fitting 15. The hearing aid unit 11 is of conventional form and it will be understood that it includes an electro-acoustical earphone coupled to the output port 16, a microphone and an amplifier for driving the earphone from electrical signals produced by the microphone. As is conventional, the acoustical impedance of the output port 15 may be quite high, on the order of that provided by a volume in a range of about 0.02 to 0.1 cc.

At the opposite end of the coupler 10, an output coupling 18 is provided which is of generally tubular form. It has an outer surface 19 for receiving the end of tubular member 20 which is connected to or part of the earmold 12, the term "earmold" being used herein to include any device which transmits sound into the ear cavity. Sound is propagated through a central passage 21 of the output coupling 18 and into a central passage 22 of the member 20.

In accordance with the invention, a first wall portion 24 is provided within the housing 13 adjacent the output port 16 of the hearing aid unit 11, separating the output port 16 from a first chamber 25 provided within the hollow housing 13.

A passage 26 is provided which has an input end 27 adjacent the output port 16 of the hearing aid unit 11 and which extends through the first wall portion 24 and to an output end 28. In the construction as illustrated, the passage 26 is formed by the central opening of a tube 30 and the output end 28 terminates in the first chamber 25. A second wall portion 31 is provided within the tubular housing 13, to divide the space therewithin into the first chamber 25 and a second chamber 32 which is coupled to the passage 21 of the output coupling 18. In addition, a second passage 33 is provided between the chambers 25 and 32 and is formed by the central opening of a tube 34 which extends through and is supported by the second wall portion 31.

The chambers 25 and 32 provide acoustic elements which have relatively high acoustic compliances and which are effectively in shunt relation to the path of propagation of acoustic energy. The passages 26 and 33 provide acoustic elements which have relatively high acoustic inertances and which are effectively in series relation to the path of energy propagation. Such elements within the coupler 11 cooperate to provide a low-pass filter which efficiently transmits low frequency components, while attenuating high frequency components. As shown, the diameters of the passages, especially that of the passage 26, are quite small with correspondingly small cross-sectional areas to have the advantage of providing large inertances even though the lengths of the passages are relatively short, substantially less than the length of the coupler in each case. Another advantage of using a small cross-sectional area is that the acoustic resistance is increased especially at higher frequencies. As aforementioned, the acoustic mass increases inversely with the cross-sectional area and the acoustic resistance increases inversely with the square of the cross-sectional area and in proportion to the square root of frequency, at higher frequencies. With the construction of the invention, the desired inertances are obtained without using a coiled tube or the like and the desired resistances are obtained without using any separate damping elements.

Figure 5:
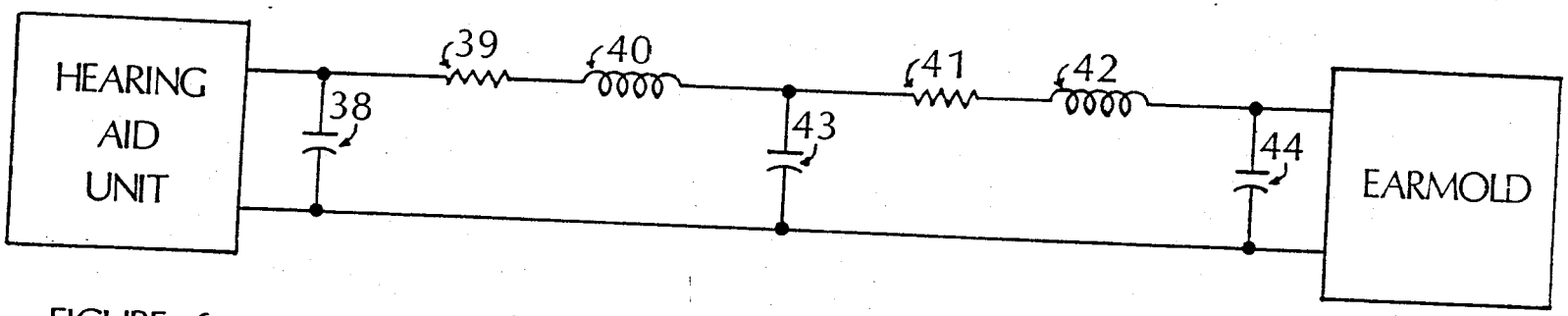
FIG. 5 is a schematic diagram using electrical symbols to represent the various acoustic elements of the construction of FIG. 2, for an explanation of the operation thereof.

FIG. 5 is a schematic diagram using symbols for electrical inductance, capacitance and resistance to represent the acoustical inertance, compliance and resistance of elements of the coupler 10 of FIG. 2. The compliance of a small chamber between the end of the fitting 15 and the first wall portion 24, designated by reference numeral 37 in FIG. 2, is represented as a capacitor 38. Resistor 39 and inductor 40 represent the resistance and inertance of the passage 26; resistor 41 and inductor 42 represent the resistance and inertance of the passage 33 and capacitors 43 and 44 represent the compliances of the chambers 25 and 32. The inertance and resistance of the passage 21 in the output coupling 18 are not shown in FIG. 5. Passage 21 may have a diameter about equal to that of the central passage 22 of member 20 to be an extension thereof, in effect. However, a different diameter may be used. For example a smaller diameter may be used to obtain increased inertance and resistance at this point.

It will be apparent that the coupler 10 as shown in FIG. 2 is configured to operate as a low-pass filter, with an operation which generally corresponds to that of its electrical low-pass filter counterpart of FIG. 5. One difference is that whereas electrical resistors are generally assumed to have resistances which are independent of frequency, the acoustic resistances of the passages increase approximately as the square root of frequency at higher frequencies and as a result, an enhanced attenuation at higher frequencies is obtained.

Figure 8:
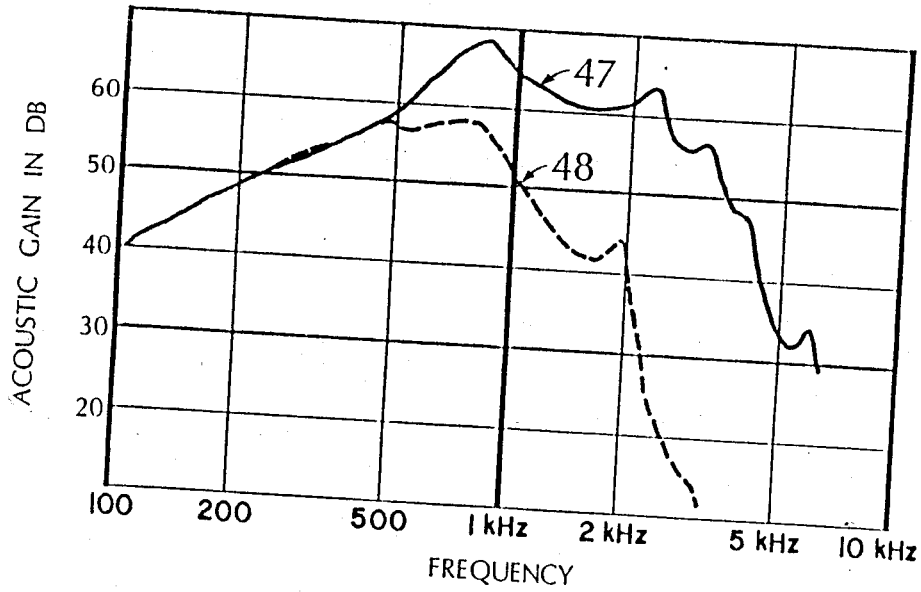
FIGS. 8, 9 and 10 are graphs showing frequency response characteristics obtained with the constructions of FIGS. 2, 3 and 4, respectively.

With reference to FIG. 8, the solid line curve 47 and the broken line curve 48 respectively indicate the frequency response characteristics obtained with a stock earhook and with a coupler 10 as shown in FIG. 2, connected in both cases to a conventional hearing aid unit and to #13 tubing, i.e. to a conventional earmold. With the coupler 10, a peak response is obtained at about 350 Hz and it falls off at about 10 dB per octave between 350 and 1300 Hz, then falling off at about 30 dB per octave above 1300 Hz.

By way of example and not by way of limitation, the key acoustic components of the coupler 10 of FIG. 2 may have dimensions as follows:

| Passage or chamber | Diameter | Length |
|---|---|---|
| 25 | 4.2 mm | 10.0 mm |
| 26 | 0.4 mm | 10.5 mm |
| 32 | 4.2 mm | 7.0 mm |
| 33 | 1.0 mm | 15.0 mm |

The passage 21 in the output coupling 18 may have a diameter of 1.93 mm and a length of 5.0 mm and, as aforementioned, the earmold passage 22 may form an extension thereof.

Figure 3:
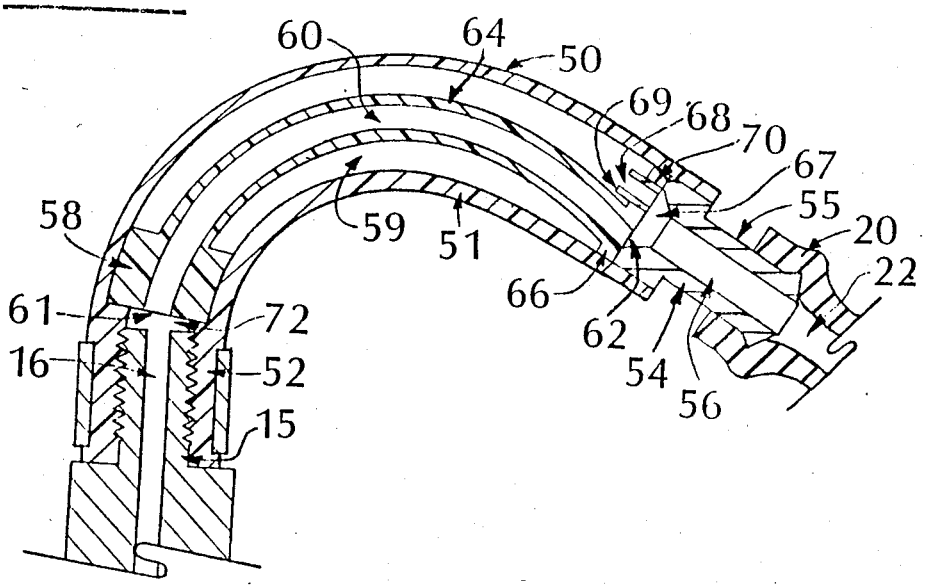
FIG. 3 is a cross-sectional view similar to FIG. 2, illustrating the construction of another embodiment of coupler constructed, in accordance with the invention, operative as a "notch filter earhook"

FIG. 3 is a cross-sectional view similar to FIG. 2 but showing a notch filter coupler 50 of the invention. The notch filter coupler 50 is similar in many respects to the coupler 10 shown in FIG. 2 and includes a hollow generally tubular housing 51 with an integral input coupling 52 at one end threaded onto the externally threaded output nozzle or fitting 15 of the hearing aid unit 11. An output coupling 54 is provided which is like the output coupling 18 of FIG. 2, having an outer surface 55 for receiving the end of a tubular member 20 which is connected to or part of the earmold 12. Sound is propagated through a central passage 56 of the coupling 54 and into the central passage 22 of the member 20.

The coupler 50 also includes a first wall portion 58 within the housing 51 adjacent the output port 16 of the hearing aid unit, separating the output port 16 from a first chamber 59 within the housing 51. A passage 60 is provided which has an input end 61 adjacent the output port 16 and which extends through the wall portion 58 into an output end 62. In the construction as illustrated, the passage 60 is formed by the central opening of a tube 64 one end of which is inserted into an opening on the wall portion 58 and the opposite end of which is inserted into an opening of a second wall portion 66. The second wall portion 66 separates the chamber 59 from a relatively small chamber 67 which is formed by a recess in the portion of the coupling 54 which is within the output end of the housing 51. A second passage is defined by the central opening 68 of a short tube 69 inserted into an opening 70 of the second wall portion 66.

In the coupler 50, the path of acoustic energy propagation is from the output port 16 of the hearing aid unit and through the passage 60 and thence through the chamber 67 and into the passage 56 of the output coupling 54. The passage 68 of the tube 69 provides an acoustic inertance element which is in series with the high acoustic compliance of the chamber 59, the series combination having a very low impedance at a certain frequency and being in shunt relation to the path of energy propagation.

Figure 6:
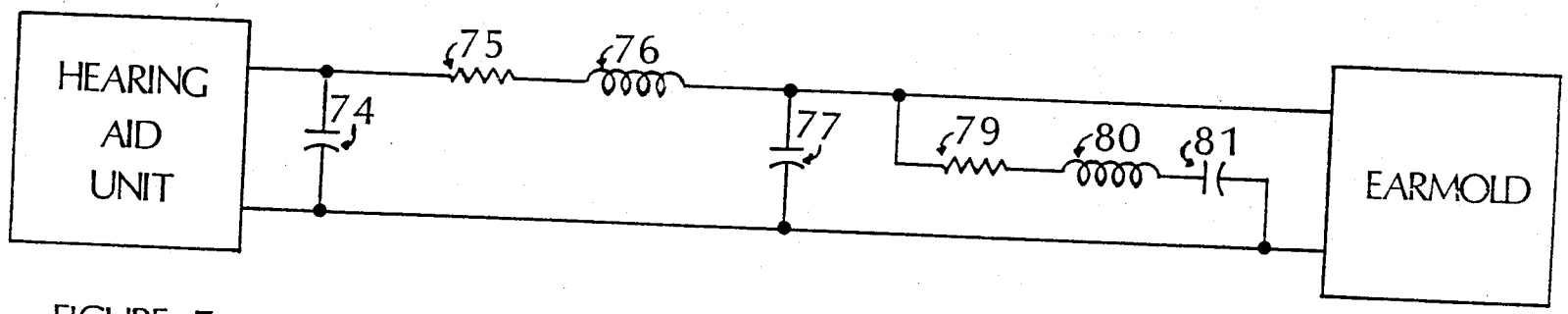
FIG. 6 is a schematic diagram similar to FIG. 5, but corresponding to the construction of FIG. 3.

FIG. 6 is a schematic diagram similar to FIG. 5 but corresponding to the coupler 50 of FIG. 3. The compliance of a small chamber 72 between the end of the fitting 15 and the first wall portion 58 is represented by a capacitor 74. Resistor 75 and inductor 76 represent the resistance and inertance of the passage 60; capacitor 77 represents the compliance of the chamber 67; resistor 79 and inductor 80 represent the resistance and inertance of the passage 68; and capacitor 81 represents the compliance of the chamber 59. The volumes of the chambers 67 and 72 are quite small so that the corresponding acoustical impedances are quite large and they have a minimal effect on the frequency response of the system. The diameter of the passage 60 is relatively large, as compared to the diameter of the passage 26 in the low-pass embodiment of FIG. 2 and its effect is comparable to that of a conventional earhook coupler. The response characteristic is, however, changed very substantially at a certain frequency as a result of the low acoustic shunt impedance which is provided by the series combination of the passage 68 and chamber 59.

Figure 9:
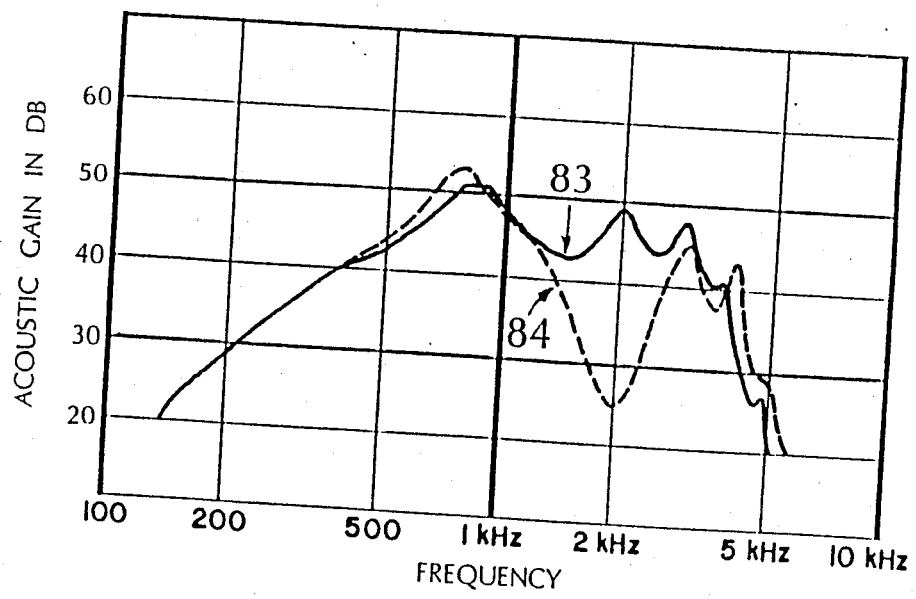

Referring to FIG. 9, the solid line curve 83 and the broken line curve 84 respectively indicate the frequency response characteristics obtained with a stock earhook and with a coupler 50 as shown in FIG. 3, connected in both cases to a conventional hearing aid unit and to #13 tubing, i.e. to a conventional earmold. As is shown, the two response characteristics are substantially the same except at a frequency range from about 1500 Hz to about 3000 Hz where it is decreased very substantially there being a minimum response at about 2000 Hz. This response characteristic is very important in correcting certain hearing problems and is readily obtained with the construction shown in FIG. 3, using elements which are all contained within a compact coupler unit.

By way of example and not by way of limitation, the key acoustic components of the coupler 50 of FIG. 3 may have dimensions as follows:

| Passage or chamber | Diameter | Length |
|---|---|---|
| 59 | 4.2 mm | 13.0 mm |
| 60 | 1.5 mm | 20.0 mm |
| 67 | 2.5 mm | 1.0 mm |
| 68 | 0.69 mm | 1.5 mm |

Figure 4:
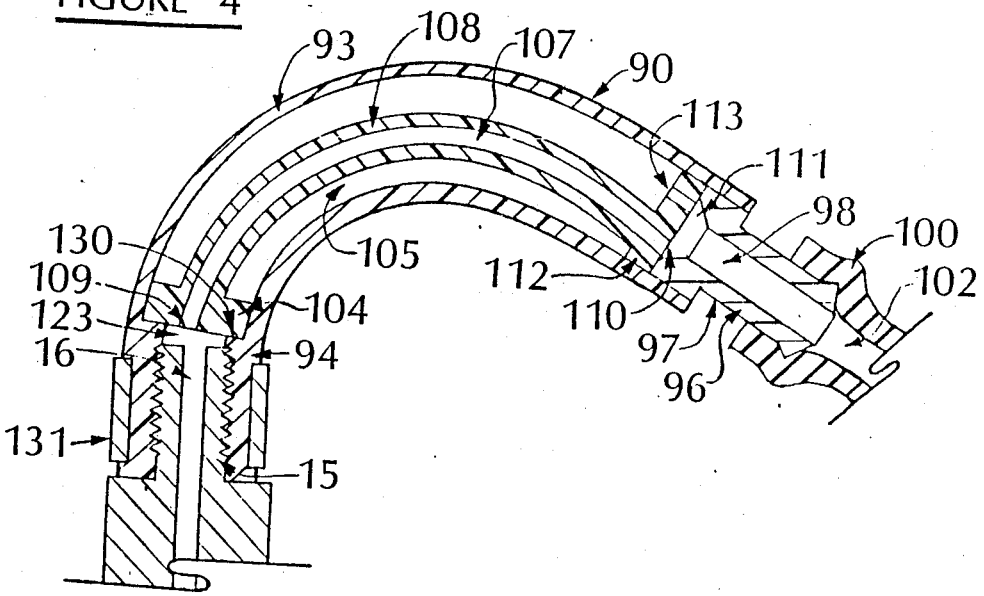
FIG. 4 is a cross-sectional view similar to FIG. 2 and 3 showing the construction of a third embodiment of coupler according to the invention, the embodiment of FIG. 4 being operative as a "high-pass earhook"

FIG. 4 is a cross-sectional view similar to FIGS. 2 and 3 but showing a high-pass coupler 90. The high-pass coupler 90 is quite similar to the coupler 50. It includes a housing 93 with an integral input coupling 94 at one end and an output coupling 96 which has an outside cylindrical surface 97 and an internal passage 98 therethrough. Output coupling 96 is coupled to a member 100 which has a central passage 102 and which may be part of a standard earmold. It is optionally possible to use the high-pass coupler with special earmolds such as dual-diameter earmolds which attenuate mid-frequencies and boost high frequencies. The coupler 90 further includes a first wall portion 104 within the housing 93, separating the output port 16 of the hearing aid unit from a first chamber 105 within the housing 93. A passage 107 is formed by the central opening of a tube 108 to extend from an input end 109 adjacent the output port 16 to an input end 110, at a chamber 111 formed by a recess in the fitting 96 and adjacent a second wall portion 112 of the coupler 90, between the chamber 111 and the chamber 105. Wall portion 112 has an opening 113 therethrough, providing a passage between the chambers 105 and 111.

The high-pass coupler of FIG. 4 differs from the notch filter coupler 50 of FIG. 3 with respect to the dimensions of the passages and chambers. The diameter of the passage 107 is substantially less than that of the corresponding passage 60 in FIG. 3 and its acoustical inertance is substantially higher. The result is a downward shift in the frequency at which a first principal peak response of the system is obtained. The diameter and length of the passage 113 are also less than those of the corresponding passage 68 in FIG. 3 and the length and volume of the chamber 105 are greater than those of the corresponding chamber 59 in FIG. 3. These changes, together with the change in the passage 107, cooperate to produce a decreased response in a relatively broad mid-frequency range, while providing a high response at high frequencies.

Figure 7:
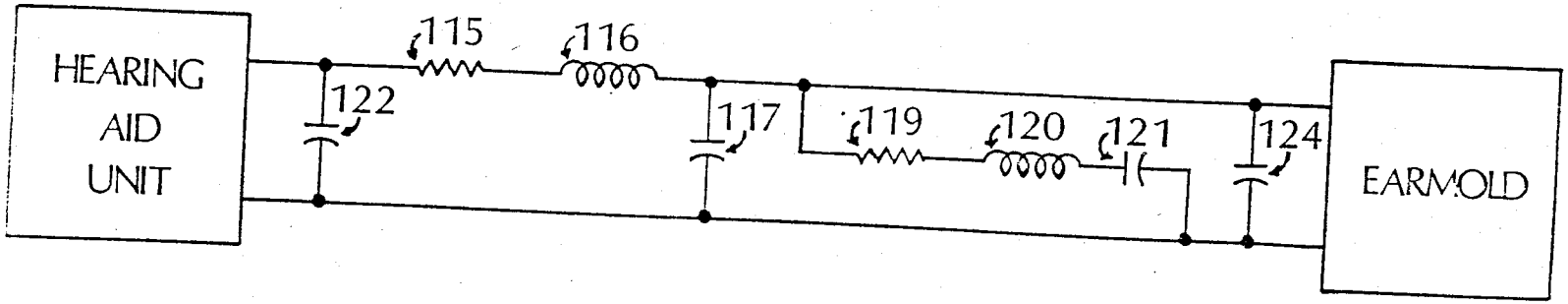
FIG. 7 is another schematic diagram similar to FIGS. 5 and 6, but corresponding to the construction of FIG. 4.

FIG. 7 is a schematic diagram which corresponds to the coupler 90 of FIG. 4. It is like the schematic diagram of FIG. 6 which corresponds to the coupler 50 of FIG. 3, since the principal differences between the couplers 50 and 90 is with respect to the dimensions of passages and chambers. In FIG. 7, resistor 115 and inductor 116 represent the resistance and inertance of the passage 107, capacitor 117 represents the compliance of chamber 111, resistor 119 and inductor 120 represent the resistance and inertance of the passage 113, capacitor 121 represents the compliance of the chamber 105, and capacitor 122 represents the compliance of a chamber 123 between the end of fitting 15 and the first wall protion 104.

A capacitor 124 is shown which represents the compliance of the passage 98 in the output coupling 96. It is important that this compliance be quite small in the high-pass coupler 90, to obtain enhanced response at the high frequency end of the audible spectrum and, for the same reason, it ,is particularly important that the compliances of chambers 111 and 123, as represented by capacitors 117 and 122, be quite small. It is noted that the output coupling passages in the FIG. 2 and FIG. 3 embodiments do, of course, have compliances but they are not represented in the diagrams of FIGS. 5 and 6 because such passages may normally be of the same size as the entrance passages of the earmolds to form extensions thereof, in effect, and they do not have a substantial effect on the operation of the FIG. 2 and FIG. 3 embodiments.

Figure 10:
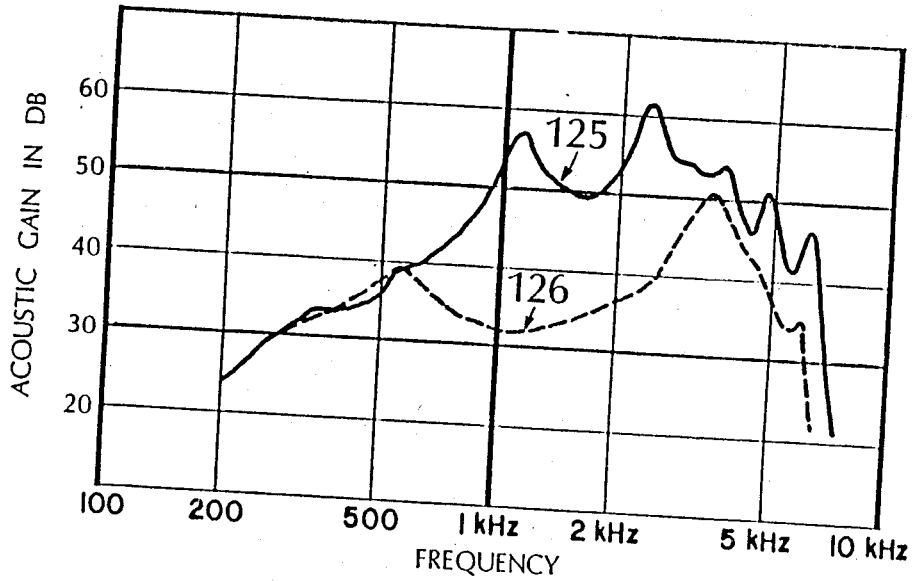

In FIG. 10, the solid line curve 125 and the broken line cure 126 respectively indicate the frequency response characteristics obtained with a stock earhook and with a coupler 90 as shown in FIG. 4, connected in both cases to a conventional hearing aid unit and to #13 tubing, i.e. to a conventional earmold. As is shown, the first peak of the broken line curve 26 is at a frequency of about 600 Hz which is substantially lower than the frequencey of more than 1000 Hz at which the first peak of the solid line curve occurs, and the first peak of the broken line curve is of substantial lower amplitude. Between 600 Hz and about 3000 Hz, the curve 126 is considerable lower than the curve 125. Above 3000 Hz the curve 125 somewhat lower than the curve 126 but is quite high in relation to the lower frequency portion of curve 125 and thus the curve 125 represents considerable enhancement of the response at high frequencies. The lowering of the frequency and amplitude of the first peak are due in large part to the high inertance of the passage 107, which is in series relation to the path of energy propagation, and which functions to produce the first peak by operating in combination with compliances in the system which are in shunt relation to the path of energy propagation, including the compliances of the hearing aid unit, earmold and coupling sections. The reduced response in the higher frequency portion of the mid-frequency range, up to about 3000 Hz, is due of course to the series combination of the inertance of passage 113 and chamber 105, the combination being in shunt relation to the path of energy propagation.

By way of example and not be way of limitation, the key components of the coupler 90 of FIG. 4 may have dimensions as follows:

| Passage or chamber | Diameter | Length |
|---|---|---|
| 105 | 4.2 | 18.0 |
| 107 | 0.86 | 22.0 |
| 111 | 2.5 | 1.0 |
| 113 | 0.4 | 1.0 |

The passage 98 in the output coupling 96 may have a length of 5 mm. while having a diameter of about 0.8 mm, less than half the diameter of the output coupling passages of the FIG. 2 and FIG. 3 embodiments. As a result, the compliance in shunt relation, to the path of energy propagation is decreased and, as a result, the high frequency response is increased.

With respect to manufacture of the couplers, it is noted that passages may either be in the form of the central passages of conventional tubes which are supported in wall portions, such as tubes 30, 34 and 69 as illustrated, or they may be formed in walls or wall portions. For example, as shown in FIG. 4, the tube 108 is integral with and connects the wall portions 104 and 112. Preferably, either one or the other of the input and output couplings is either formed integrally with one end of the housing or connected thereto, and an assembly of internal components is installed from the opposite end, after which the other of the couplings is installed. In FIG. 4, for example, the coupling 94 is integral with the housing 93 and it forms a shoulder 130 which is engaged by the wall portion 104 when the assembly of wall portions 104 and 112 and tube 108 is installed. The coupling 96 is installed to engage the wall portion 112 and it may be secured in place through the use of a suitable adhesive or through a solvent or heat-bonding operation. As shown in FIG. 4, a metal holding ring 131 is secured around the coupling 94, similar metal rings being provided in the FIG. 2 and FIG. 3 embodiments. Other parts are preferably of plastic. The hollow housing members may be disposed in an unbent condition during assembly and may be formed of a plastic which can be formed to the shapes as illustrated after assembly and when heated, but which retain such shapes after being cooled.

Couplers of the invention have important advantages in solving "problem" cases, but can be used in general purpose applications for improving the hearing of the more common types of hearing impairments. They have the generally desirable effect of providing coupling to a compliance which is in shunt relation to the path of energy propagation while avoiding oscillation-creating feedback of energy to the microphone of the hearing aid unit. In the illustrated embodiments, the chambers 25, 59 and 105 provide such compliances and there is substantially no feedback communication between such chambers and the microphone of the hearing aid unit.

Figure 11:
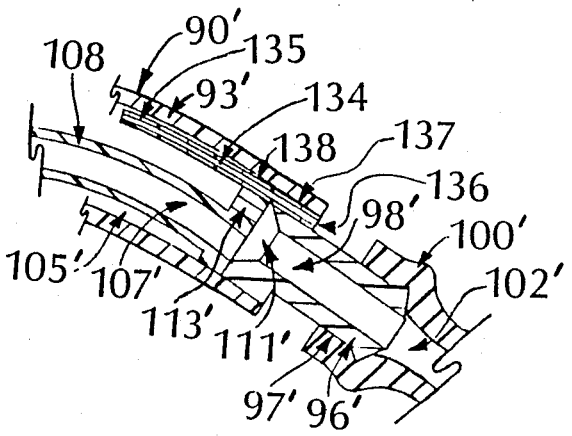
FIG. 11 shows a modified coupler.

It is also possible to use such chamber or chambers similar thereto in arrangements which provide substantial feedback isolation while permitting venting or communication with the outside free air space. FIG. 11 illustrates a portion of a modified coupler 90' which is generally similar to the coupler 90, corresponding parts being indicated by primed numbers. In the modified coupler 90', a passage 134 is provided by the central opening of a tube 135 which has one end 136 on the outside of the coupler and which extends through openings 137 and 138 the coupling 96' portion 112' and into the chamber 105'. The effect is to provide highly effective venting without any special earmolds and while minimizing oscillatory feedback effects which may be produced by earmold venting.

It will be understood that modifications and variations may be effected without departing from the spirit and scope of the novel concepts of the invention.

I claim:

1. An acoustic coupler for use between an output port of a hearing aid unit and an earmold or the like at the entrance to the ear of a wearer and for obtaining a predetermined frequency response characteristic related to the needs of the wearer, said acoustic coupler comprising: hollow housing means, input coupling means at one end of said hollow housing means for coupling to said output port of said hearing aid unit, output coupling means at an opposite end of said hollow housing means for coupling to said earmold, said hollow housing means providing a first chamber therewithin, acoustic elements within said hollow housing means having certain acoustic characteristics and arranged for coupling of said first chamber to said output coupling means, a wall portion within said hollow housing means disposed adjacent said output port of said hearing aid unit and between said output port and said first chamber, and means within said hollow housing means defining a first passage having an input end coupled to said output port of said hearing aid unit and extending through said wall portion and to an output end coupled to said first chamber and to said output coupling means, said passage being elongated and having a cross-sectional size and a volume which are small in relation to those of said first chamber to provide an acoustic element having a relatively high acoustic inertance while said first chamber provides an acoustic element having a relatively high acoustic compliance, said relatively high acoustic inertance of said first passage and said relatively high acoustic compliance of said first chamber cooperating with said acoustic characteristics of said acoustic elements to form an acoustic network which cooperates with said hearing aid unit and said earmold to obtain said predetermined response characteristic related to the needs of the wearer.

2. An acoustic coupler as defined in claim 1 for use with a hearing aid unit which includes a fitting having an externally threaded surface and having a central opening which defines said output port, said input coupling means including a member having a central opening which defines an internal surface adapted to be threaded onto said externally threaded surface of said fitting to position said separating wall and said input end of said first passage in proximity to the terminal end of said fitting and to said output port.

3. An acoustic coupler as defined in claim 2, adapted to be positioned behind the ear of a wearer, said hollow housing means being in the form of an earhook for extending from said output port of said hearing aid unit up and over the ear of the wearer and down to an earmold positioned in the ear cavity.

4. An acoustic coupler as defined in claim 1, adapted for use in aiding the hearing of a wearer who has a hearing loss in a low frequency range, said first passage and said first chamber cooperating with said acoustic elements to form a low-pass acoustic network and to obtain amplification of low frequency components in relation to high frequency components.

5. An acoustic coupler as defined in claim 1, said first passage and said chamber cooperating with said acoustic elements to form an acoustic network operative as a notch filter to attenuate frequency components in a certain narrow frequency range.

6. An acoustic coupler as defined in claim 5, adapted for use in aiding the hearing of a wearer who has a hearing loss at frequencies above and below said narrow frequency range, said acoustic network being operative to permit higher amplification of components at frequencies above and below said narrow frequency range.

7. An acoustic coupler as defined in claim 5, adapted for use in aiding the hearing of a wearer who has a hearing loss in a high frequency range and for use in combination with a dual diameter earmold or the like which attenuates low frequency components but which allows excessive response in said narrow frequency range, said acoustic network being operative to cooperate with said earmold to obtain enhanced response at high frequencies without said excessive response in said narrow frequency range.

8. An acoustic coupler as defined in claim 1, further comprising: a second wall portion within said hollow housing means and located to provide a second chamber between said first chamber and said output coupling means and operative as an acoustic compliance to form one of said acoustic elements, and means within said hollow housing means defining a second passage which is between said first and second chambers and which operates as an acoustic inertance to form another of said acoustic elements.

9. An acoustic coupler as defined in claim 8 wherein said output end of said first passage is within said first chamber and wherein the path of acoustic energy propagation is through said first passage and into said first chamber and thence through said second passage and into said second chamber and thence through said output coupling means and into said earmold.

10. An acoustic coupler as defined in claim 9 wherein said second passage is elongated and of small cross-sectional area to provide a high acoustic inertance and to inhibit propagation of high frequency components.

11. An acoustic coupler as defined in claim 10 wherein atubular member extends through said second wall portion and defines said second passage.

12. An acoustic coupler as defined in claim 8 wherein said output end of said first passage is at said second chamber and wherein the path of acoustic energy propagation is through said first passage and thence through said second chamber and thence through said output coupling means and into said earmold, said second passage and said second chamber providing an acoustic inertance and an acoustic compliance in series relation to each other and in shunt relation to said path of acoustic energy propagation.

* * * * *